United States Patent [19]

Etou et al.

[11] Patent Number: 4,512,162

[45] Date of Patent: Apr. 23, 1985

[54] REFRIGERATOR

[75] Inventors: Kazumi Etou; Tetsuo Komoto, both of Osaka, Japan

[73] Assignee: Tokyo Shibaura Denki Kabushiki Kaisha, Kawasaki, Japan

[21] Appl. No.: 573,346

[22] Filed: Jan. 24, 1984

[30] Foreign Application Priority Data

May 18, 1983 [JP] Japan ..... 58-88078

[51] Int. Cl.[3] ..... F25D 19/00

[52] U.S. Cl. ..... 62/298; 62/449; 62/525

[58] Field of Search ..... 62/517, 520, 526, 525, 62/524, 448, 449, 298

[56] References Cited

U.S. PATENT DOCUMENTS 2,387,465 10/1945 Peltier ..... 62/449

2,432,931 12/1947 Peltier ..... 62/520 X 3,261,173 7/1966 Gould ..... 62/449 X 4,044,570 8/1977 Ono et al. ..... 62/419

4,077,229 3/1978 Gelbart et al. ..... 62/283

4,270,364 6/1981 Oonishi et al. ..... 62/198

*Primary Examiner*—William E. Wayner

*Assistant Examiner*—John Sollecito

*Attorney, Agent, or Firm*—Cushman, Darby & Cushman

[57] ABSTRACT

A freezer compartment with a main evaporator and an auxiliary evaporator connected by piping with the main evaporator, and having an opening at the back. The main evaporator is fitted on the inside of the back cover which closes off the opening such that both evaporators can be inserted into the inner freezing compartment through the opening. A support member is fitted along the upper rim of the opening at the back to reinforce the top of the cover which closes the opening.

12 Claims, 9 Drawing Figures

REFRIGERATOR

BACKGROUND OF THE INVENTION

This invention relates to a refrigerator which has a freezer compartment within a thermal cabinet and, in particular, an evaporator for direct cooling and an evaporator for producing a cold blast in the freezer compartment.

In general, thermally insulated refrigerator cabinets have a first inner compartment for use as a freezer and a second inner compartment for use for refrigeration. Both compartments are inside a single outer cabinet with the spaces between the outside surfaces of these inner compartments and the inside surface of the outer cabinet filled with thermal insulation material.

Refrigerators constructed with this kind of thermal insulation include the direct cooling type in which the freezer compartment is formed by the evaporator itself and, as shown in U.S. Pat. Nos. 4,044,570 and 4,077,229, the cold blast circulation type in in which the freezer compartment is divided into a freezer compartment proper and an air passage, with this air passage having within it an evaporator for the freezer compartment and a fan for directing a cold blast into the freezer compartment. The evaporator is inserted into the freezer compartment through the front opening.

In the direct-cooling type of freezer compartment, the rate of cooling of food placed in contact with the wall surface is rapid, but that of food placed away from the cooling wall surface, e.g. on a shelf, is slow. In contrast, the rate of cooling of food placed away from the walls in the cold blast circulation type is rapid compared with the direct-cooling type, but slow when the food is placed against the walls.

In order to overcome this disadvantage, efforts have been made recently to provide a type of construction in which food is placed in a cold blast circulation type freezer compartment and an auxiliary evaporator is provided which cools the food by direct contact.

But in this kind of construction, since both the main evaporator for producing the cold blast and the auxiliary evaporator for cooling the food by direct contact are positioned within the freezer compartment, the work involved in routing the pipes for these two evaporations to the outside of the inner freezer compartment and connecting them with the piping system of the rest of the refrigerator which includes the evaporator for the refrigeration compartment, is extremely difficult, and owing to this difficulty there is a risk of poor connections.

The object of this invention is a refrigerator in which, firstly, the work of connecting to the refrigeration cycle system which includes the main and auxiliary evaporator of the freezer compartment, is easy and not prone to poor connections. Secondly, the object is to permit the freezer compartment to maintain a high degree of rigidity so that it can withstand the load imposed upon it by fixtures such as the main evaporator and auxiliary evaporator.

SUMMARY OF THE INVENTION

This is achieved according to the present invention in that the inner compartment used as a freezer compartment has an opening at the back. The main evaporator for the freezer compartment, which is connected by piping with the auxiliary freezer compartment evaporator, is fitted on the inside of the back cover which closes off this opening. Therefore, the main and auxiliary evaporators can be inserted into the inner compartment through the opening. A support member is fitted along the upper rim of the opening at the back to reinforce the top of the cover which closes the opening.

BRIEF DESCRIPTION OF THE DRAWINGS

The drawings show an embodiment of the invention.

DETAILED DESCRIPTION OF THE INVENTION

Figure 1:
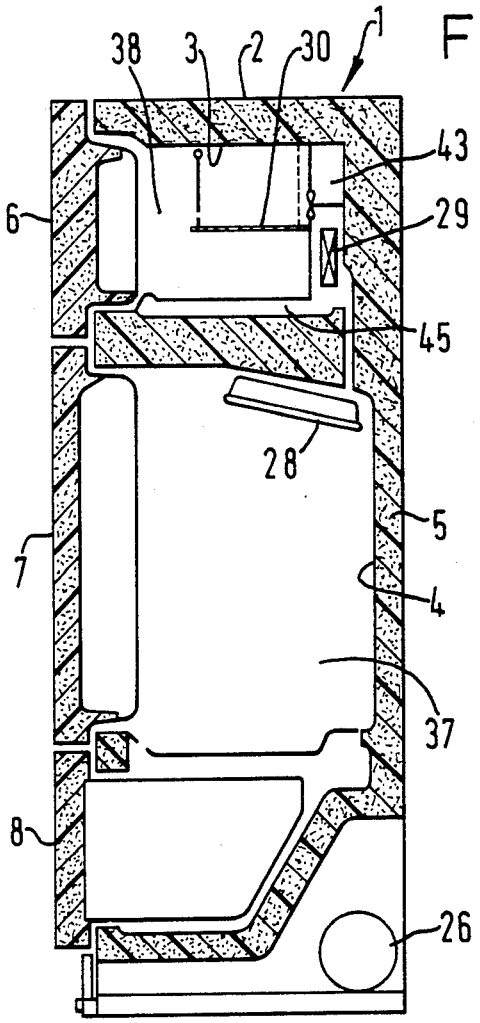
FIG. 1 is a schematic drawing of a side view (longitudinal section) of the refrigerator.

An explanation follows, referring to the drawings, of an embodiment of the invention. A thermal cabinet 1 of a refrigerator consists, as shown in FIG. 1, of an outer box 2; a plastic inner compartment 3 defining the freezer and a plastic inner compartment 4 for refrigeration; a thermal insulation layer 5 formed by filling with insulation material the space between compartments 3 and 4 and outer box 2; a freezer compartment door 6, a refrigerator compartment door 7, and a vegetable storage compartment door 8. As illustrated mainly in FIGS. 3 to 7, inner freezer compartment 3 has an opening 9 in its back wall, opposite the opening at its front. A top flange **9*c* and a bottom flange 9*d* are formed at the top and a bottom of this opening, parts of which project rearwards beyond flanges 9*a* and 9*b* on either side. A back cover 10 closes opening 9. A support member 11 is provided for attaching back cover 10 to opening 9 at the back of freezer compartment 3. Member 11 is made of plastic, and in general terms, is long, narrow, and shaped to fit the upper edge of opening 9. As shown in FIG. 4, support member 11 is secured in position along the upper edge of opening 9 by a plurality of projections 12 formed on the inner face of this member and extending into the holes 13 (FIG. 3) previously formed in top flange 9*c* of opening 9 of compartment 3. The ends of projections 12 also are inserted into the holes 14*a* of the tongued fasteners 14 which are formed integrally at the bottom of the support member 11 as an extension of it and which are flexible. The back cover 10 is made of plastic and formed into a shape which enables its borders to cover the left and right flanges 9*a* and 9*b*, bottom flange 9*d* of opening 9 and the bottom part of support member 11 in close contact therewith. A plurality of hooks 15 are formed integrally at the top of cover 10 and engage over the upper edge 16 of support member 11 so cover 10 hangs down therefrom. A shaft hole 18 formed at the center of the support member 11 is thus positioned inside a semi-circular cut-out part 17 previously formed at the center of the top edge of back cover 10**.

Figure 6:
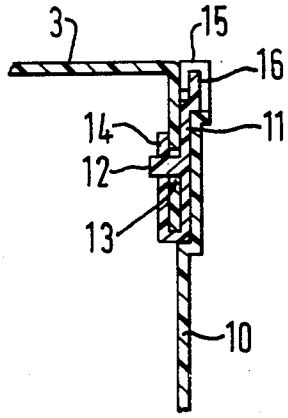
FIG. 6 is a side view of a longitudinal section of cut-away part of the body of the freezer compartment.
Figure 6:
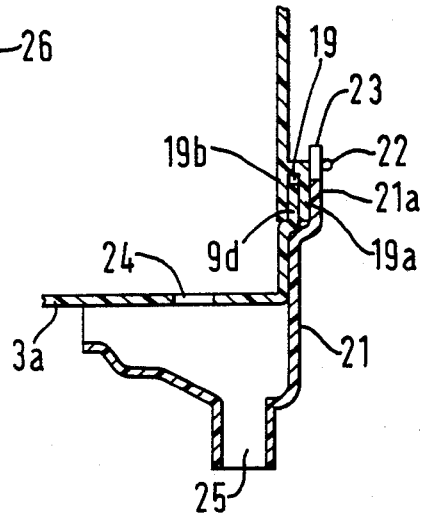
Figure 3:
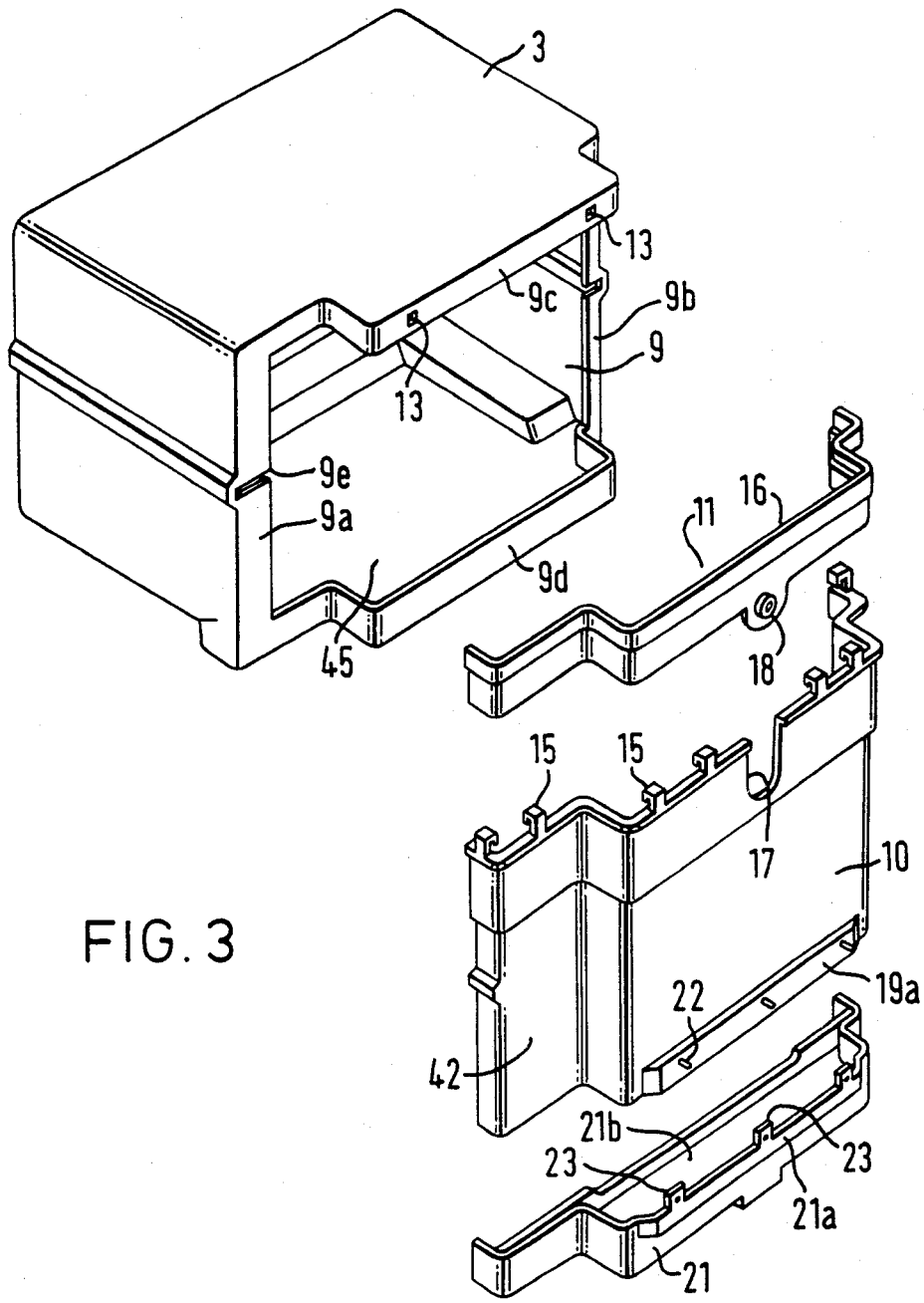
FIG. 3 is an oblique exploded view of the members which constitute the body of the freezer compartment.
Figure 4:
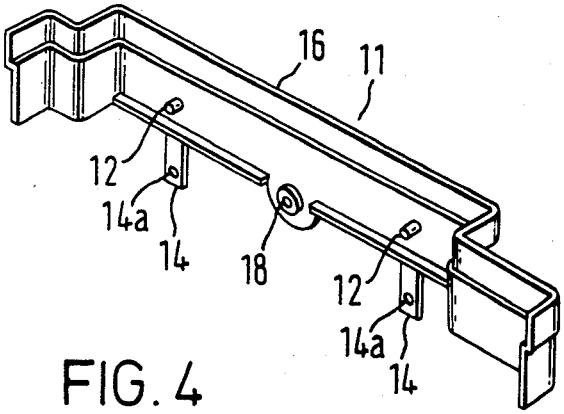
FIG. 4 is an oblique view of the support member, seen from inside.
Figure 5:
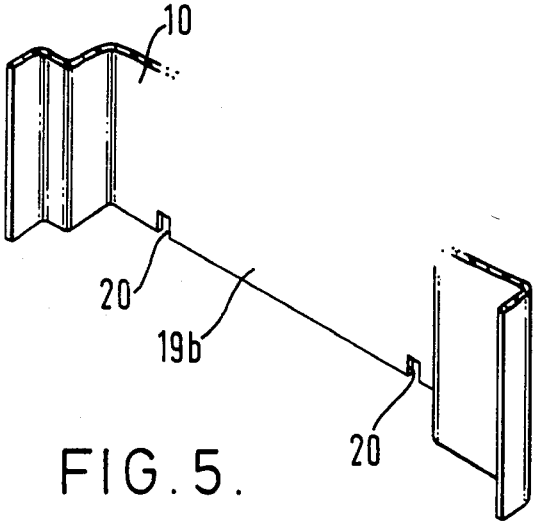
FIG. 5 is an oblique view of a cut-away part of the back cover, seen from inside.

Further, a long narrow section 19, open on its underside, is formed at the bottom of back cover 10, as shown in FIGS. 3 and 5, with a channel wall 19*a* on the outer side of the channel. The bottom flange side of the back opening of freezer compartment 3 is inserted add channel 19. Two flexible parts at the ends of bottom flange 9*d* fit into two notches 20 formed on inner wall 19*b* of channel 19. Referring to FIG. 6, in order to attach drainage trough 21, a plurality of projections 22 formed integrally at the top of outer wall 19*a* of channel 19 and a plurality of tongued fasteners 23 formed integrally on the upper edge of back wall 21*a* of drainage trough 21 are joined by inserting the projections into the tongued fasteners.

By this means, drainage trough 21 is fitted so that its back wall 21 is positioned in such a way that it overlaps the back of the bottom end of back cover 10, including outer wall 19*a* of channel 19, while its open part 21*b* (FIG. 3) is positioned underneath base 3*a* of freezer compartment 3, which is provided with drainage hole 24 (FIG. 6). Drainage outlet hole 24 formed at the bottom of drainage trough 21 is connected to a waste water receptacle such as an evaporation tray via a suitable drainage pipe.

Figure 9:
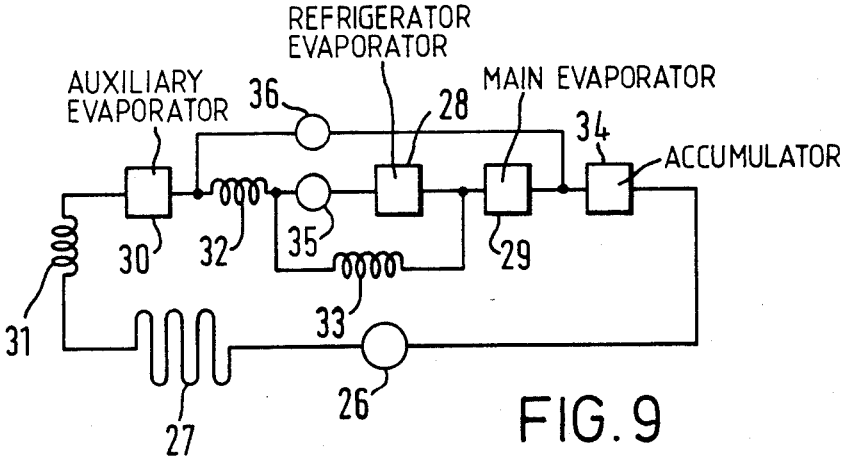
FIG. 9 is a drawing of the flow of the refrigerant in the refrigeration cycle.

An embodiment of the refrigeration cycle system in this refrigerator is shown in FIG. 9. The refrigeration cycle system has a closed circuit, connecting in series a compressor 26, a condenser 27, a capillary tube 31, a freezer compartment auxiliary evaporator 30, a capillary tube 32, a control valve 35, a switch for controlling the flow path of the refrigerant, a refrigeration compartment main evaporator 29, and an accumulator 34. A parallel circuit includes a capillary tube 33 for bypassing the refrigeration compartment evaporator 28; and a parallel circuit including a flow control valve 36 for bypassing capillary tube 32, a control valve 35, evaporator 28, and main evaporator 29, all connected in series.

In the initial stage of cooling of the freezer and refrigeration compartments, cooling is effected by passing the refrigerant through auxiliary evaporator 30, refrigeration compartment evaporator 28, and main evaporator 29, with valve 35 open and valve 36 closed. When the temperature of refrigeration compartment 4 falls to a set level, control valve 35 closes, and by this means the refrigerant flows through auxiliary evaporator 30 and main evaporator 29 in series and cools the freezer compartment 3 rapidly. Thereafter, when the temperature of freezer compartment 3 falls to a set level, compressor 26 ceases to operate. When the control valve 36 is open, the refrigerant flows only to auxiliary evaporator 30.

Figure 7:
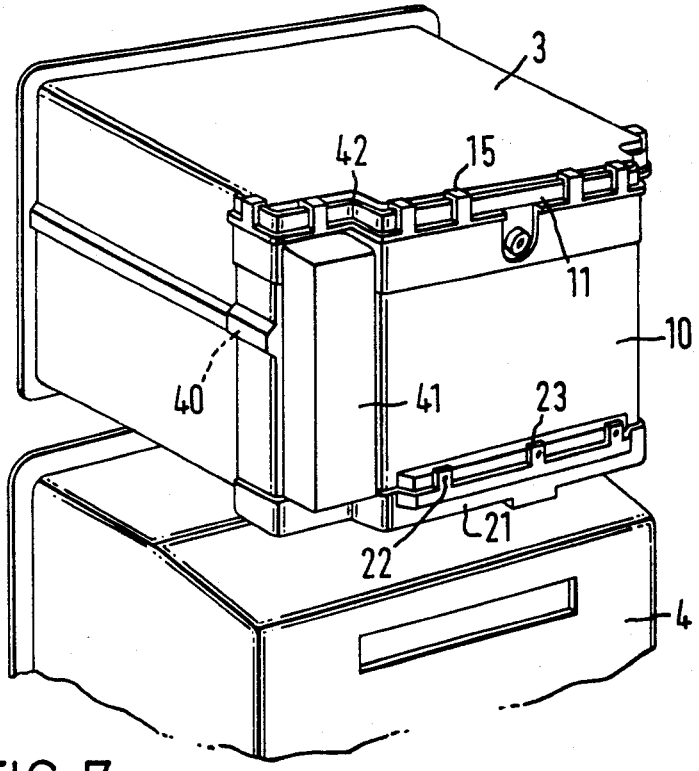
FIG. 7 is an oblique view of the back of the body of the freezer compartment in its assembled state, but omitting the piping.
Figure 8:
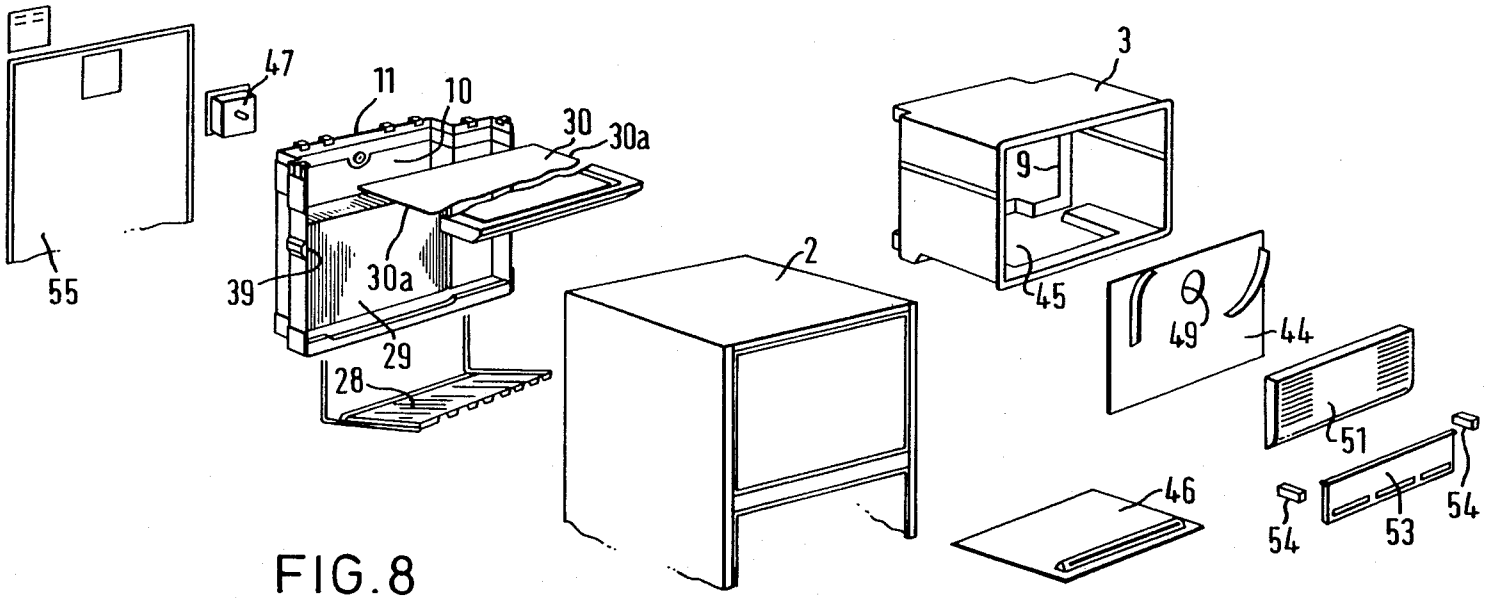
FIG. 8 is an oblique exploded view of the elements of the freezer compartment.

The main and auxiliary evaporators 29 and 30 in this type of refrigeration cycle system are attached to back cover 10 before cover 10 is fitted into opening 9 at the back of freezer compartment 3. That is to say, as shown in FIGS. 7 and 8, main evaporator 29 is fixed, by means of screws, etc. to the inside of back cover 10, forming a finned air passage, while auxiliary evaporator 30, which takes the form of a panel on which the food is placed, and which cools this food by direct contact, is mounted by sliding its left and right edges 30*a* into supporting grooves 39 and 40, which are formed in the fore-and-aft direction on the two side walls of back cover 10 and inner compartment 3. Auxiliary evaporator 30 is attached at a position approximately at half the height of inner compartment 3.

Accumulator 34 and control valves 35 and 36 are housed in a valve container box 41 (FIG. 7). Box 41 is attached to a recess 42 which is formed on the outside of back cover 10, as shown in FIG. 3. Thus main evaporator 29 and auxiliary evaporator 30 and valves 35 and 36 are attached to the back cover 10, and are connected by pipes to the main parts of the refrigeration cycle system, including refrigeration compartment evaporator 28.

Figure 2:
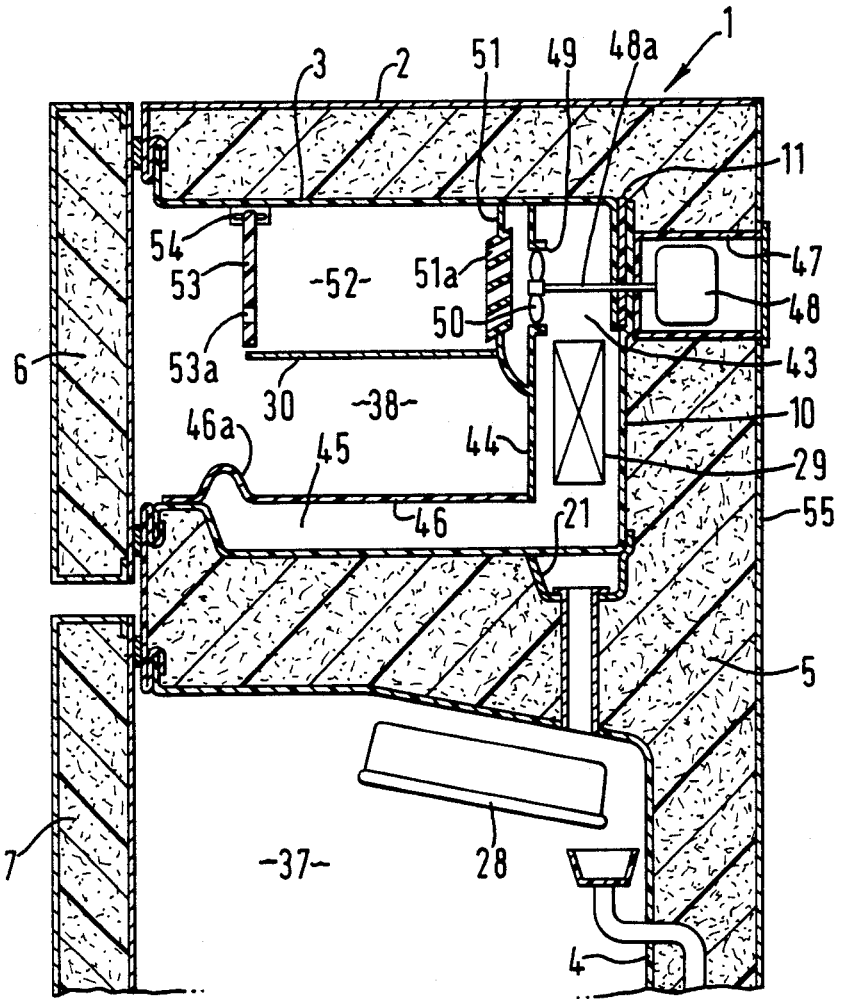
FIG. 2 is a similar drawing of the freezer compartment.

Next, main evaporator 29 and auxiliary evaporator 30 are inserted into inner compartment 3 from the rear, through opening 9, and then back cover 10 is fitted to opening 9 as previously described. In order to divide inner box 3 into freezer compartment 38 and an air passage 43, a divider panel 44 is provided, as illustrated in outline in FIG. 2, positioned so that it faces back cover 10 with main evaporator 29 inbetween, and a floor panel 46 is placed over the base of freezer compartment box 3 so as to cover the opening at the top of a duct space 45 formed on this base and constituting part of the air passage. A fan motor case 47 is attached by appropriate means to back cover 10 at the center of the back of back cover 10 where semi-circular cut-out part 17 is formed.

The rotating shaft 48*a* of a fan motor 48 mounted inside fan motor case 47 passes through the shaft hole 18 formed in the support member 11, and is fitted at its tip with a fan blade 50 positioned within discharge opening 49 previously formed in divider panel 44. In front of fan 50, a fan guard 51 is provided, with louvre openings 51*a* formed so that they are positioned above auxiliary evaporator 30. When fan 50 is driven by fan motor 48, the air in freezer compartment 38 is drawn, via suction ports 46*a* formed at the front of floor panel 46, into duct space 45. The indrawn air passes through main compartment 29 in air passage 43, and is discharged, via discharge opening 49 of divider panel 44 and openings 51*a* in fan guard 51, into freezer compartment 38, more specifically into the space above auxiliary evaporator 30. In order to make the space above auxiliary evaporator 30 into a rapid cooling compartment 52, an auxiliary door 53 with a vent hole 53*a* formed in it is attached to the front opening of this space by means of a pair of support members 54 in such a way that it can open and shut freely, and can also be attached or removed freely. A back plate 55 is provided to close off the opening at the back of outer box 2 after back cover 10 has been fitted. Thermal insulation layer 5 is formed by filling the space between outer box 2 and inner boxes with insulation material such as foam urethane and foaming it.

With this invention, the following effects can be expected, as can be understood from the embodiment described above. The refrigerator is provided with an auxiliary evaporator for the direct cooling of food which is placed directly on it, within the freezer compartment. Air is force-circulated by a fan through the air passage in which is placed the main evaporator. Thus food can be cooled more rapidly if it is placed on the auxiliary evaporator than when cooled by a cold blast alone so cooling is more rapid than in refrigerators constructed with conventional direct-cooling freezing compartments.

While the construction is such that an auxiliary evaporator producing these advantageous effects is provided, it is possible, because the construction is such that the freezer compartment box has an opening at the back closed off with a back cover to which the main evaporator is fitted, and the auxiliary evaporator is positioned inside the back cover, to connect the principal parts of the refrigeration cycle, including the refrigeration compartment evaporator, with pipes before the main and auxiliary evaporators are assembled into the inner box, and then to assemble them into the inner box through the opening at the back of this inner box. Consequently, the pipe connecting work can be carried outside the freezing compartment or even the refrigerator, so that the operation is made simpler and poor connections can be prevented. In addition, in spite of the fact the inner freezing compartment has thin walls and an opening at the back, so that in itself it is easily deformable, the provision of the support member for securing the back cover, which is fitted to the top edge of this opening at the back, ensures that overall rigidity of the box is increased, and that it can stand up comfortably to the load imposed by the evaporator valves, etc.

What is claimed is:

1. A refrigerator having a freezer compartment comprising:

an outer box;

an inner freezer compartment, spaced from said outer box;

a layer of insulating material between said outer box and said inner compartment;

a main evaporator mounted in said inner compartment;

an auxiliary evaporator mounted in said inner compartment and connected to said main evaporator;

said inner compartment having a back opening for permitting insertion into said inner compartment, in assembling both said evaporators, means for covering said opening on which said main evaporator is attached;

a support member secured to said inner compartment along an upper edge of said opening for attaching said covering means to said inner compartment;

means for dividing the space within said inner compartment to define an air passage therein; and a fan motor for circulating cooled air in said passage and inner compartment.

2. A refrigerator as in claim 1, wherein said covering means includes a plurality of hooks formed integrally at the top of said covering means means and engaged over an upper edge of said support member, so that said covering means hangs therefrom.

3. A refrigerator as in claim 1, wherein said auxiliary evaporator is a plate.

4. A refrigerator as in claim 1, wherein said main evaporator is a fixed tube type and said auxiliary evaporator is a plate.

5. A refrigerator as in claim 3, wherein said auxiliary evaporator is received at both edges into supporting grooves on side walls of said covering means and inner compartment.

6. A refrigerator as in claim 5, wherein said auxiliary evaporator is attached at a position of approximately half the height of the said inner compartment.

7. A refrigerator as in claim 3, wherein said auxiliary evaporator is provided to be opposite to a louvre opening of said dividing means.

8. A refrigerator as in claim 7, wherein an auxiliary door with a vent hole is attached to a front opening opposite said louvre opening.

9. A refrigerator as in claim 1, wherein said support member has a shaft hole through which a shaft of said fan motor passes.

10. A refrigerator as in claim 1, wherein said securing means incudes a plurality of projections formed on an inner face of said member and wherein said covering means includes a back cover with holes through which said projections pass through, said securing means also having flexible projections formed integrally at the bottom of said member as an extension thereof and having holes through which said projections pass.

11. A refrigerator as in claim 1, wherein said covering means includes a drainage trough.

12. A refrigerator as in claim 1, further including a second inner compartment for use as refrigerator compartment and a direct cooling evaporator in said second compartment for cooling the interior thereof.

* * * * *